US008414093B2

(12) United States Patent
Moran

(10) Patent No.: US 8,414,093 B2
(45) Date of Patent: Apr. 9, 2013

(54) MOTORIZED MOVEABLE SHELF ASSEMBLY FOR CABINET STRUCTURES

(76) Inventor: Eric M. Moran, Camano Island, WA (US)

( * ) Notice: Subject to any disclaimer, the term of this patent is extended or adjusted under 35 U.S.C. 154(b) by 357 days.

(21) Appl. No.: 12/772,027

(22) Filed: Apr. 30, 2010

(65) Prior Publication Data

US 2011/0266936 A1 Nov. 3, 2011

(51) Int. Cl.
*A47B 77/00* (2006.01)

(52) U.S. Cl.
USPC ..... 312/248; 312/246; 312/319.6

(58) Field of Classification Search ..... 312/245, 312/246, 247, 248, 266, 319.1, 319.2, 319.3, 312/319.5, 319.6
See application file for complete search history.

(56) References Cited

U.S. PATENT DOCUMENTS

| | | | | | |
|---|---|---|---|---|---|
| 883,305 | A | | 3/1908 | Fetch | |
| 2,555,254 | A | * | 5/1951 | Stebbins | 312/319.7 |
| 2,710,782 | A | | 6/1955 | Chaft | |
| 2,822,229 | A | | 2/1958 | Carlson | |
| 3,224,827 | A | * | 12/1965 | Foster et al. | 312/266 |
| 3,425,761 | A | | 2/1969 | Schreyer | |
| 3,857,623 | A | | 12/1974 | Schneller | |
| 4,076,351 | A | * | 2/1978 | Wyant | 312/247 |
| 4,258,967 | A | | 3/1981 | Boudreau | |
| 4,560,859 | A | | 12/1985 | Brennan | |
| 4,582,372 | A | | 4/1986 | Cooper | |
| 4,688,686 | A | | 8/1987 | Mitts et al. | |
| 4,736,689 | A | | 4/1988 | Stanko | |
| 4,738,495 | A | | 4/1988 | Mitts | |
| 4,756,054 | A | | 7/1988 | Mitts et al. | |
| 5,076,649 | A | * | 12/1991 | Therkelsen | 312/246 |
| 5,213,401 | A | | 5/1993 | Hatcher | |
| 5,228,763 | A | * | 7/1993 | Gingold | 312/266 |
| 5,249,858 | A | * | 10/1993 | Nusser | 312/319.6 |
| 5,308,158 | A | * | 5/1994 | Vogelgesang et al. | 312/319.3 |
| 5,944,201 | A | | 8/1999 | Babboni et al. | |
| 6,039,423 | A | | 3/2000 | Fulterer | |
| 6,247,771 | B1 | | 6/2001 | Miller | |
| 6,296,337 | B1 | | 10/2001 | Kawanabe | |
| 6,367,898 | B1 | * | 4/2002 | Jobe | 312/246 |

(Continued)

OTHER PUBLICATIONS

"Rev-A-Shelf Pull Down Shelving System 5PD Series," Rev-A-Shelf, LLC product installation instructions, Oct. 2004.

*Primary Examiner* — James O Hansen
(74) *Attorney, Agent, or Firm* — Graham & Dunn PC; Kathleen T. Petrich

(57) ABSTRACT

A robust, motorized moveable shelf assembly having a shelf carriage, a stationary support structure, and a motorized drive assembly that can be retrofitted into an existing cabinet structure or be combined with a cabinet structure in which the shelf carriage can rotationally-move outside and either downward or upward of the stationary support structure and back again so that the shelf carriage is more readily accessible to a person of limited mobility. A linkage arm powered by a motor moves through an arcuate path to drive the shelf carriage from a first at rest position to a second extended position. In one embodiment, the shelf carriage has a bottom edge with a chamfered rear edge to provide clearance during movement. In another embodiment, the shelf carriage includes a moveable bottom flap, a rail, and a wheel attached to a lower portion of the shelf carriage where the wheel tracks the rail to eliminate the need for the chamfered rear edge. Other embodiments include barriers applied to the front of each horizontal shelf of the shelf carriage and cabinet doors attached to the front of the shelf carriage.

22 Claims, 19 Drawing Sheets

U.S. PATENT DOCUMENTS

| | | | |
|---|---|---|---|
| 6,669,315 | B2 | 12/2003 | Heidmann et al. |
| 7,140,703 | B1 | 11/2006 | Holdgate, III et al. |
| 7,635,171 | B2 | 12/2009 | Rapler, III |
| 2005/0206282 | A1 | 9/2005 | Walburn |
| 2008/0265727 | A1 | 10/2008 | Kohlman et al. |

* cited by examiner

MOTORIZED MOVEABLE SHELF ASSEMBLY FOR CABINET STRUCTURES

TECHNICAL FIELD

The present invention relates to shelves for cabinet structures that are rotationally moveable between an upper and lower plane. More particularly, the present invention relates to a robust, motorized moveable shelf assembly for improved access by those with limited mobility or where the shelf assembly in an "at rest" state is hard to reach.

BACKGROUND OF THE INVENTION

Individuals with limited mobility, such as individuals confined to wheelchairs or individuals that are stricken with arthritis or other debilitating disease or ailment, have long had trouble accessing cupboard/cabinet shelves that are not at immediate hand/arm level reach. Either such individuals give up upper cupboard/cabinet space as access to goods in such cupboard/cabinet space is impractical or they undergo extensive home/office remodels but often require larger square footage to have the same cupboard/cabinet space with upper cupboards.

Further, cathedral ceilings are all the rage. As a result, cabinet height has been increased. Even for tall people, accessing these very high cabinets (and their contents) can be challenging. It is particularly so for those that are not tall or have limited mobility due to injury or illness.

One product offering is the REV-A-SHELF 5PD Series (By the Rev-A-Shelf Company LLC of Jeffersontown, Ky.) pull down shelving system that employs mechanical linkage wire shelving system that is manually pulled down to vertically access upper shelves without using a step-stool. However, this system is not robust enough to be accessed by those with limited mobility but more designed to provide assistance to a homemaker. Further, the bottom shelf is necessarily truncated to provide clearance in movement and so critical shelf space is lost. These types of systems are not robust enough to be used in institutional settings or designed for users with limited mobility that want to stay in their existing homes.

SUMMARY OF THE INVENTION

The present invention is directed to a robust, motorized moveable shelf assembly for moving a moveable shelf carriage having at least one generally horizontally-oriented shelf from a first at rest position within a stationary support, which is adapted to fit within a cabinet structure or fixedly attached to a stationary structure (e.g., a wall) and to a different extended position outside and offset from the stationary support. The invention can be a moveable shelf assembly, having several embodiments, as a kit form or combined with the cabinet structure. The invention also includes a method of retrofitting an existing cabinet to include motor-driven moveable shelf assembly from one horizontal plane to another and back again.

According to one aspect of the invention, the moveable shelf assembly includes a shelf carriage, a pair of stationary supports sidewalls, and motorized means for moving the shelf carriage from a first at rest position to a second extended position. The shelf carriage, which includes a pair of spaced-apart sidewalls, a back support member, and at least one shelf. The stationary support sidewalls are spaced apart to accommodate the shelf carriage sidewalls to move within and outside of the stationary support sidewalls.

A drive mechanism is positioned at each of the stationary support sidewalls where each drive mechanism has a linkage arm assembly that is interconnected to one of the shelf carriage sidewalls. Each linkage arm assembly moves along an arcuate pathway to allow the linkage the arm rotary movement. A controllable, powered motor provides rotational movement to the drive mechanisms.

In one embodiment of the invention, the drive mechanism is in the form of a master drive and slave mechanism. Both the master drive and slave mechanisms have their respective linkage arms that follow the same arcuate path and are interconnected to respective sidewalls of the shelf carriage. A rotary bell gear that pivots about a center point of the arcuate path allows a drive mechanism (e.g., a chain and sprocket configuration) to lift the shelf carriage with greater efficiency and reduced energy. A cross-linkage transfers torque from the master drive to the slave mechanism. When the motor drives the master drive mechanism, the net effect is that the shelf carriage moves from its first at rest position via the linkage arms of the master drive and slave mechanisms to a second extended position. While there is a fully extended position, the invention encompasses where the shelf carriage may be stopped (or jogged) at any place along the linkage arms' arcuate path.

The master drive and slave mechanisms may be driven by a chain and gear assembly or by a belt and pulley assembly. A tensioning device may be added to take up any unnecessary slack.

The shelf or shelves of the shelf carriage may be a single horizontal plate or plank or configured to carry content multiple interior shelf units.

In one embodiment, the shelf carriage includes a bottom plate that includes a chamfered rear edge to accommodate clearance when the shelf carriage is moving between the "at rest" position and the fully extended position.

In another embodiment, the (structural support) back support member or cabinet structure includes a moveable bottom flap, in lieu of the bottom plate with chamfered rear on the shelf carriage. The moveable bottom flap may be hinged (e.g., continuously or "piano-hinged") to a lower edge of the (structural support) back support member or back of the cabinet structure. A cantilevered rail may be positioned atop of the bottom flap facing the rear of the back support member or back of the cabinet structure. A wheel may be positioned at the bottom of the shelf carriage to guide the movement of the shelf carriage along the rail while the linkage arms move the sidewalls of the shelf carriage when the motorized drive assembly is activated.

In another embodiment, barriers may be placed in front of the individual shelves so that forward content movement is minimized during movement of the shelf carriage. Cabinet style doors may be added to the front of the shelf carriage, instead of the cabinet structure itself, to provide an additional barrier between a person using the moveable shelf assembly and the shelf carriage contents during movement.

These and other advantages will become more apparent upon review of the Drawings, the Detailed Description of the Invention, and the Claims.

BRIEF DESCRIPTION OF THE DRAWINGS

Like reference numerals are used to designate like parts throughout the several views of the drawings, wherein.

DETAILED DESCRIPTION OF THE INVENTION

Referring to FIGS. 1-4, the present invention is generally directed to a robust motorized moveable shelf assembly 10 that has a shelf carriage 12 that can rotationally move outwardly and downwardly and back again from a stationary support 14. The stationary support may be adapted to fit within a conventional kitchen cupboard unit 16 or other cabinet structure in which it is desired to access contents of the cupboard in a different plane in which the cupboard exists.

Figure 1:
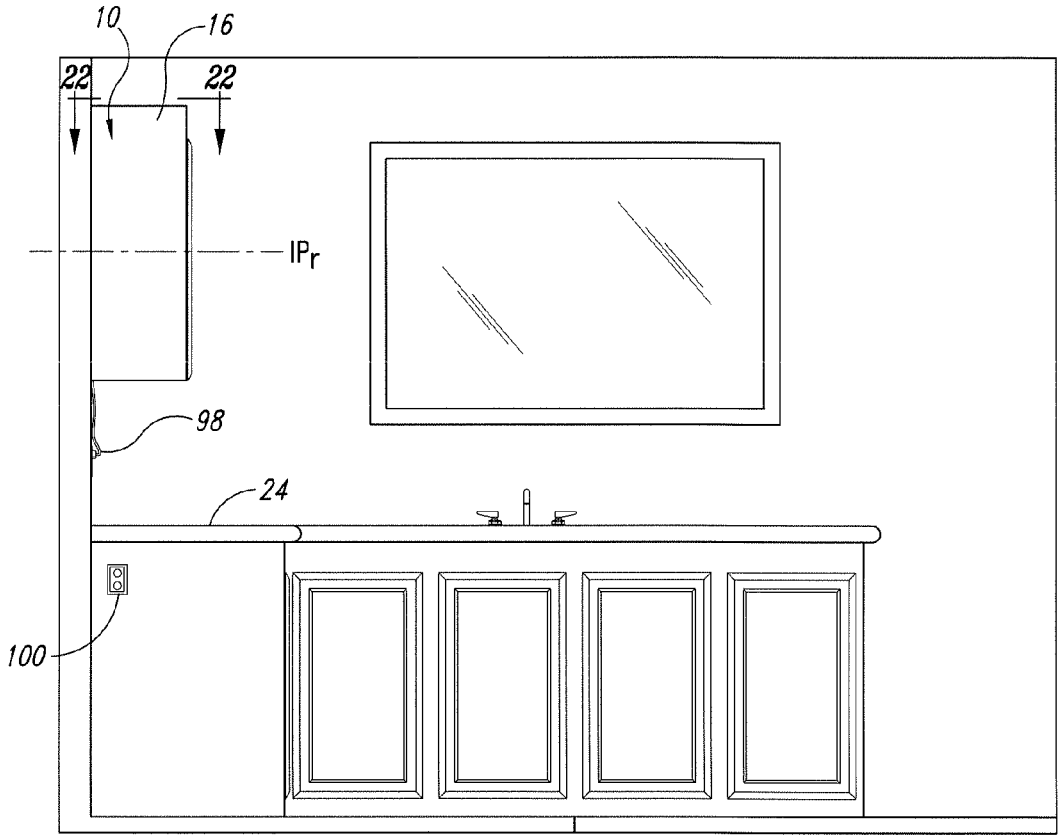
FIG. 1 is a front view of a representative kitchen with an upper cabinet and lower cabinets for storing food and/or objects to store, serve, or cook food.

As illustrated in FIG. 1, most kitchens have cupboards/cabinets on the walls to allow space for more food/dishes/cookware to maximize the kitchen's square footage. However, accessing upper cabinets for those with limited mobility can be very challenging. The same holds true for upper cabinets in bedrooms, bathrooms, garages, hallways, rec rooms, offices, and in commercial spaces. Building a custom home or office to accommodate a bigger square footage in order to position all cabinets at a level accessed by those with limited mobility is very expensive and not very practical. The present invention may be utilized to retrofit an existing upper cabinet in order to easily access shelves (and the items on the shelves) within that upper cabinet or be manufactured/sold as an all-in-one moveable shelf assembly cabinet.

Figure 2:
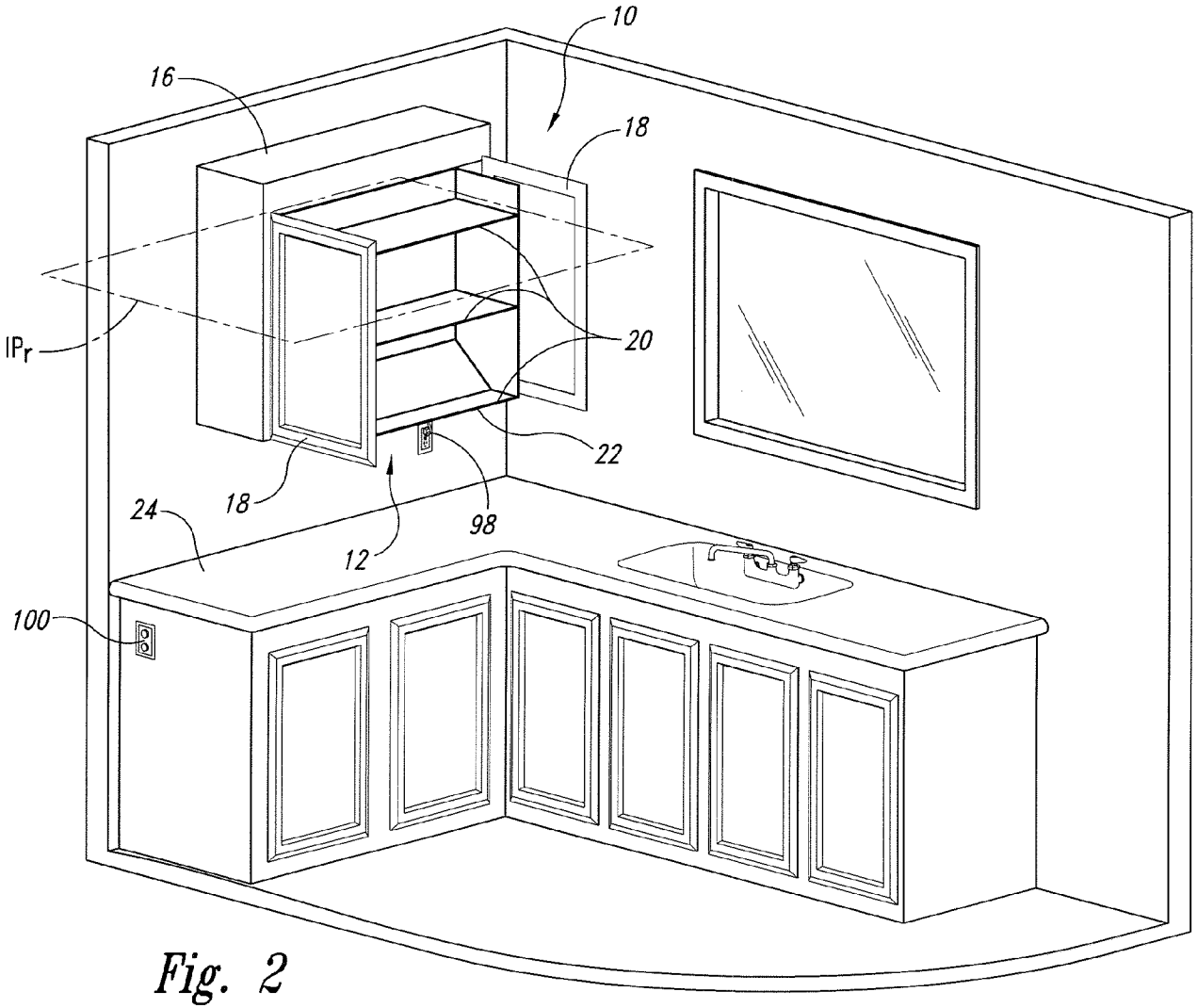
FIG. 2 is a perspective view of FIG. 1 in which the upper cabinet is opened and a moveable shelf assembly of the present invention is illustrated beginning to be rotationally moved outwardly and downwardly.
Figure 3:
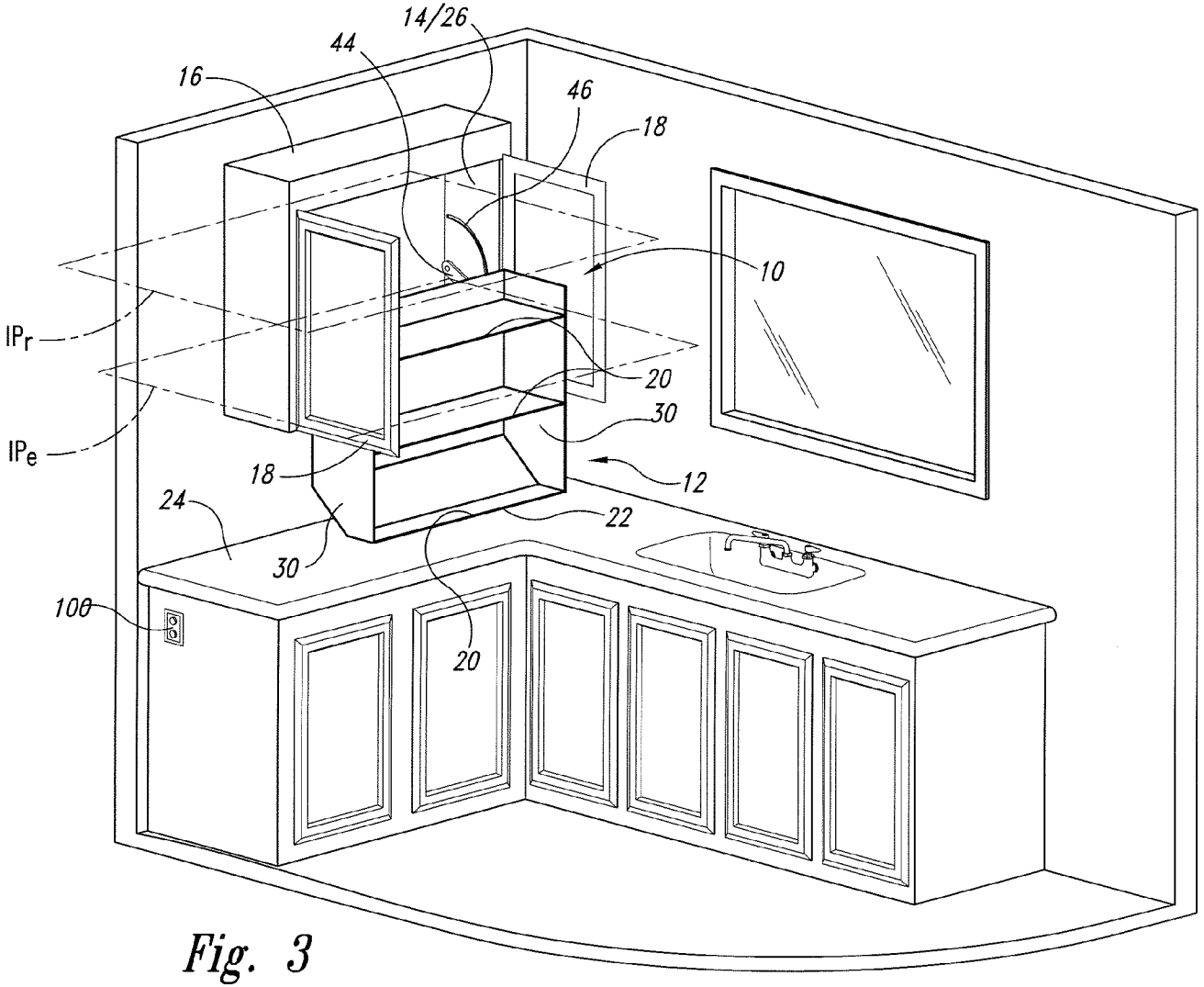
FIG. 3 is a view like that of FIG. 2 except where the moveable shelf assembly is illustrated rotationally moved to its most extended position.

The moveable shelf assembly 10 moveably rotates between a first "at rest" (quiescent) state as illustrated in FIG. 1. Upon a signal (remotely activated or directly at the site such as push button control or lever), cabinet doors 18 open (in the first embodiment), as illustrated in FIG. 2, and the moveable shelf carriage 12 rotates outwardly and downwardly so that any individual shelf 20 (or shelf unit) of shelf carriage 12 is positioned in a lower horizontal plane in the fully rotationally extended position. For example, in FIGS. 3 and 4, a bottom edge 22 of shelf carriage 12 is illustrated resting atop of a counter 24 in order for one of limited mobility to access the shelf contents of the shelf carriage.

Figure 5:
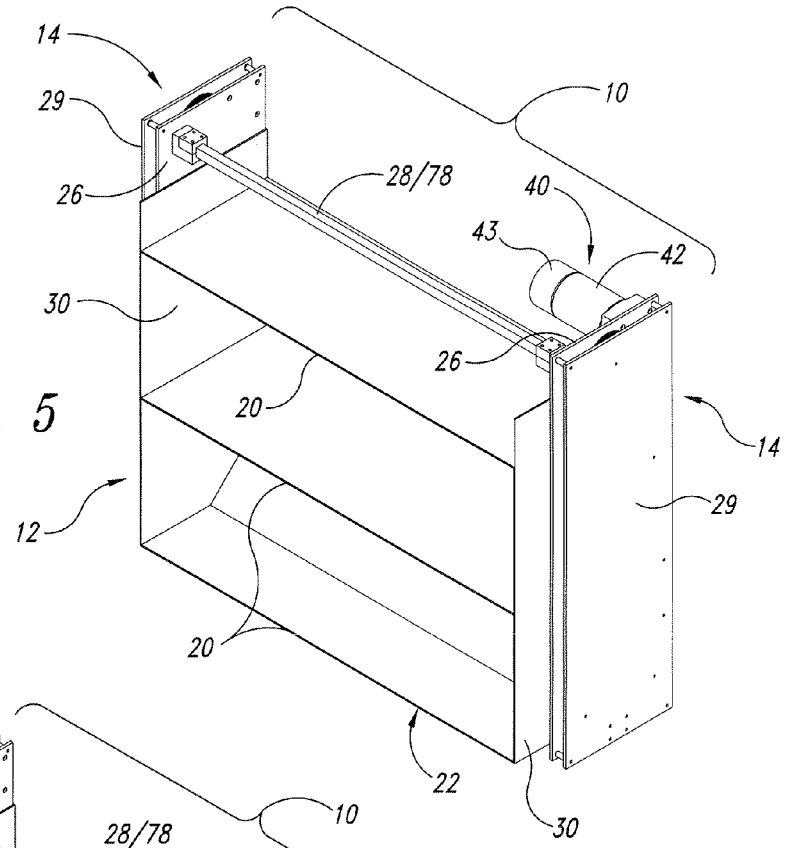
FIG. 5 is a perspective view of the moveable shelf assembly illustrated apart from the cabinet including a shelf carriage, two stationary supports, and a motorized drive assembly.

Now referring to FIGS. 5-21, a first embodiment of the moveable shelf assembly 10 is shown in more detail. FIG. 5 is an assembled perspective view illustrating the shelf carriage 12 in relationship to the stationary support 14 having a pair of spaced-apart sidewalls 26 and a cross-structural support 28. According to one aspect of the invention, the spaced-apart structural support sidewalls 14 may include a structural plate (identified with number "26") and cover plate 29 that protects the master drive and slave mechanisms discussed more in detail below. Spaced-apart sidewalls 26 are adapted to fit within a cabinet, which is generally rectangular in shape, or may be the sidewalls of the cabinet structure itself. The structural support sidewalls 14/26 may also be fixedly-joined to a wall or studs within a wall or to the back of a cabinet structure.

Figure 7:
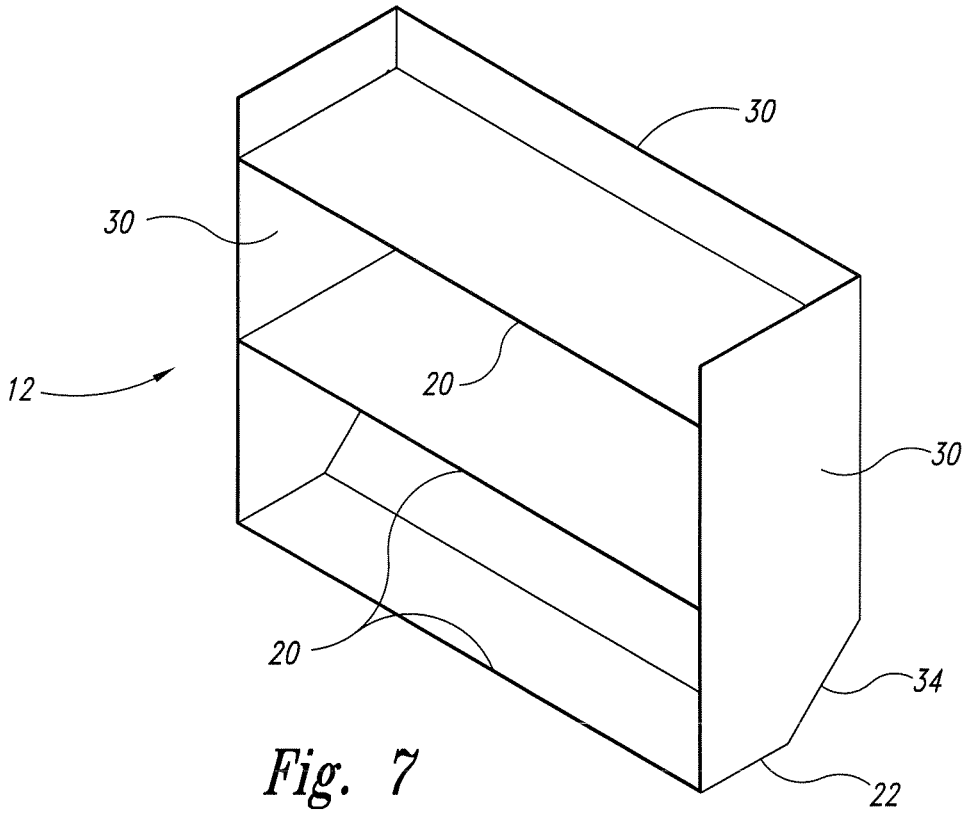
FIG. 7 is a perspective view of the shelf carriage.
Figure 8:
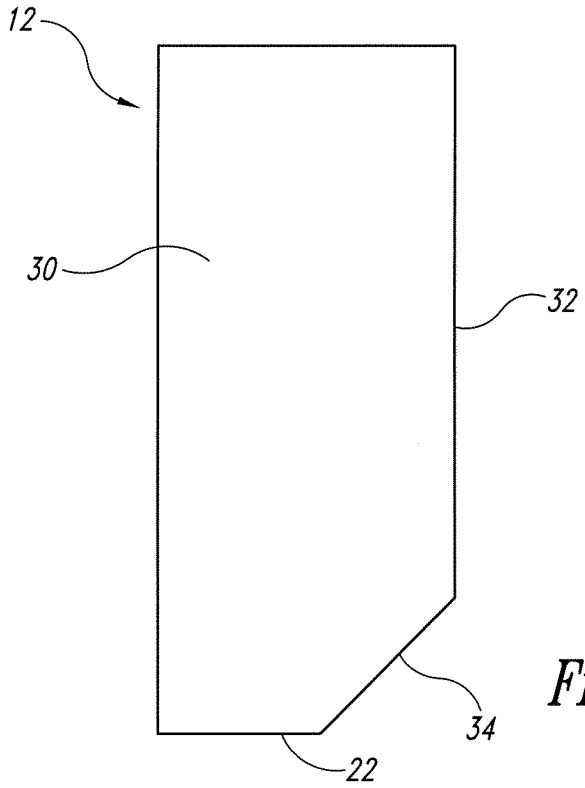
FIG. 8 is a right end view of the shelf carriage.

Referring particularly to FIGS. 7-8, shelf carriage 12 of the first moveable shelf assembly embodiment is illustrated in further detail. Shelf carriage 12 includes a pair of spaced-apart sidewalls 30, a back support member 32, and at least one generally horizontally-oriented shelf 20 (three illustrated) or configuration of shelf units 21 (e.g., FIG. 23) supported by the sidewalls 30 or a combination of at least one sidewall 30 and back support member 32 and generally spanning between the spaced-apart sidewalls 30 and back support member 32. Back support member 32 is illustrated as a single plate that fully spans between the spaced-apart sidewalls 30, but does not need to be. The back support members could be a brace or pair of braces in lieu of a unitary plate member.

The combination of the sidewalls, back support member, and at least one shelf or shelf unit forms a structure having length, width, and depth in which an imaginary horizontal plane intersects the shelf carriage approximately halfway of the length of the structure. This can best be viewed in FIGS. 5 and 7 and marked IP (imaginary plane).

According to a first embodiment of the invention, the shelf carriage includes a bottom edge 22 that is chamfered towards the rear (towards the back support member 32). A right end view of the sidewall better illustrates the chamfered edge 34. The chamfered edge provides clearance when the shelf carriage is rotationally moving outwardly of a conventional rectangular cabinet structure.

Referring particularly to FIGS. 6 and 9-21, the moveable shelf assembly also includes a motorized drive assembly 40 having a powered motor 42 (such as the BISON $1/20^{th}$ hp gear motor), a motor brake 43, a pair of linkage arms 44 connected to the shelf carriage 12 in which each linkage arm 44 travels along a respective arcuate path 46, and drive mechanisms that drive the linkage arms to travel one end of the arcuate path to the other.

According to one aspect of the invention, the drive mechanism includes a master drive mechanism 48 and a slave drive mechanism 50, which may be a gear and chain assembly, as illustrated, or a belt and pulley assembly or some other means for moving a linkage assembly well known to one of mechanical skill. Also referring more closely to FIGS. 12 and 13, a rotary bell gear assembly 52 that pivots about a centerpoint 54 of the arcuate path 46 allows a chain and sprocket drive assembly 56 to transfer torque more efficiently via rotationally chain drive uptake movement than an otherwise "dead lift." The resulting energy efficiency may be a 4:1 gear ratio, where the main sprocket 58 driven by a spur gear 60 from the motor 42 can be an 80 tooth sprocket and the remaining rotary drive gears can be 35 tooth sprockets (illustrated by numerals "62"). The positioning of rotary drive sprockets 62 relative to centerpoint 54 and rotary bell gear assembly 52 has been determined to provide the geometric benefit to maximizing lifting energy.

Rotary bell gear assembly 54 may further include rotary bell gear 64, pivot 66 that pivots about centerpoint 54, a slot 68 that may engage with stop 70, and a pocket 72 for attaching a master chain link (not illustrated) while the chain 74 follows the radial edge 76 of rotary bell gear 64.

Referring now to FIGS. 5-6, 9-10, 12, 16, and 18 a cross-linkage member 78 is added to this embodiment in order to transfer torque from the master drive mechanism to the slave mechanism. While the cross-linkage member may take one of several shapes, one aspect of the invention has the cross-linkage member having a square cross-section to provide improved torque transfer. A second spur gear 80 that drives the cross linkage member from the master drive assembly is interconnected to a cross-linkage support block 82 (FIGS. 16 and 18) in which the cross-linkage member 78 is supported. Cross-linkage support block 82 may include an base 84 that is interconnected to the spur gear 80 and an upper block member 86 of a size to support the cross-linkage member as it transfers torque to the slave mechanism.

Figure 20:
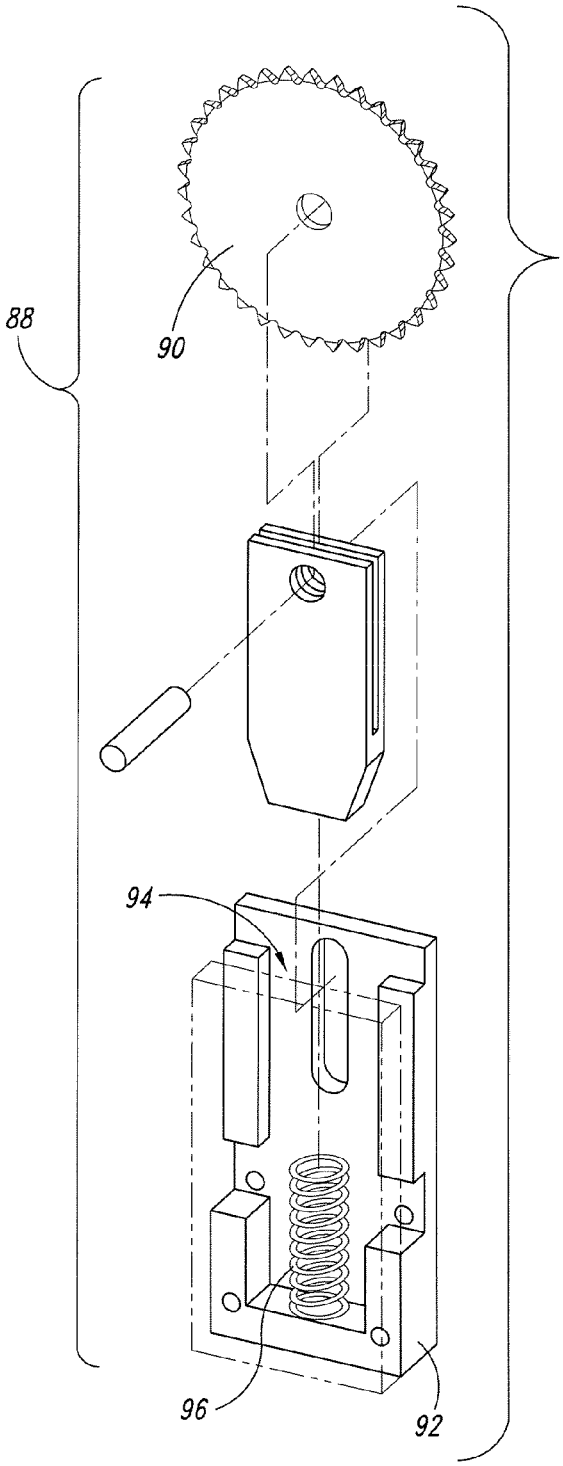
FIG. 20 is an enlarged exploded perspective of the tensioner device better illustrating the base, sprocket, and spring.
Figure 21:
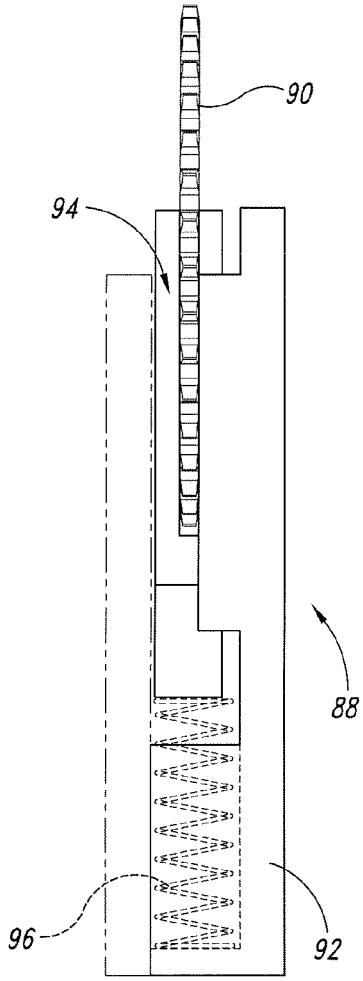
FIG. 21 is a right end view of the assembled tensioner device of FIG. 20.

Now referring particularly to FIGS. 20 and 21, a tension device 88 may be used to take up any slack in the drive assemblies (master and slave). Tension device 88 includes a tension sprocket 90, which may be the same 35 teeth sprocket as the other drive sprockets, a base 92 having that forms a pocket 94, and a spring 96. When the linkage arms of the master and slave mechanisms are in the fully retracted and fully extended positions, the spring is not fully tensioned. When the linkage arms are in between the two extremes, the spring is fully tensioned (not illustrated).

The above-referenced master and drive mechanisms are shelf good items (chain, sprocket, spur gears, and linkage arms). The exceptions are the rotary bell gear assembly, cross-linkage support block, and tension device, which are all shown enlarged (FIGS. 13, 16, and 20-21) and are easily fabricated by an ordinary machinist.

Figure 6:
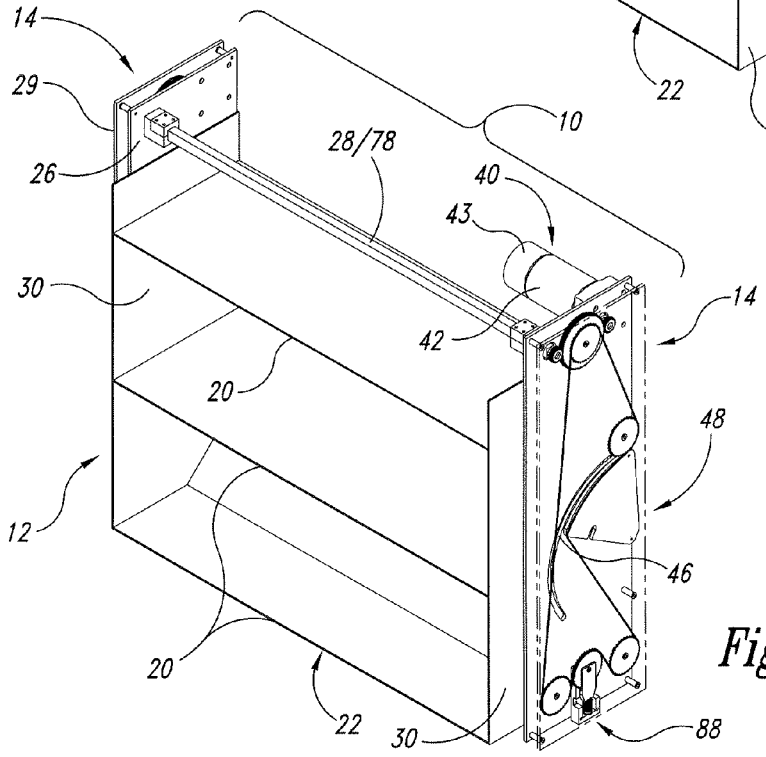
FIG. 6 is a view like FIG. 5 except better illustrating the motor drive assembly with exterior side support cover plates removed to better view the master drive and slave mechanisms.
Figure 9:
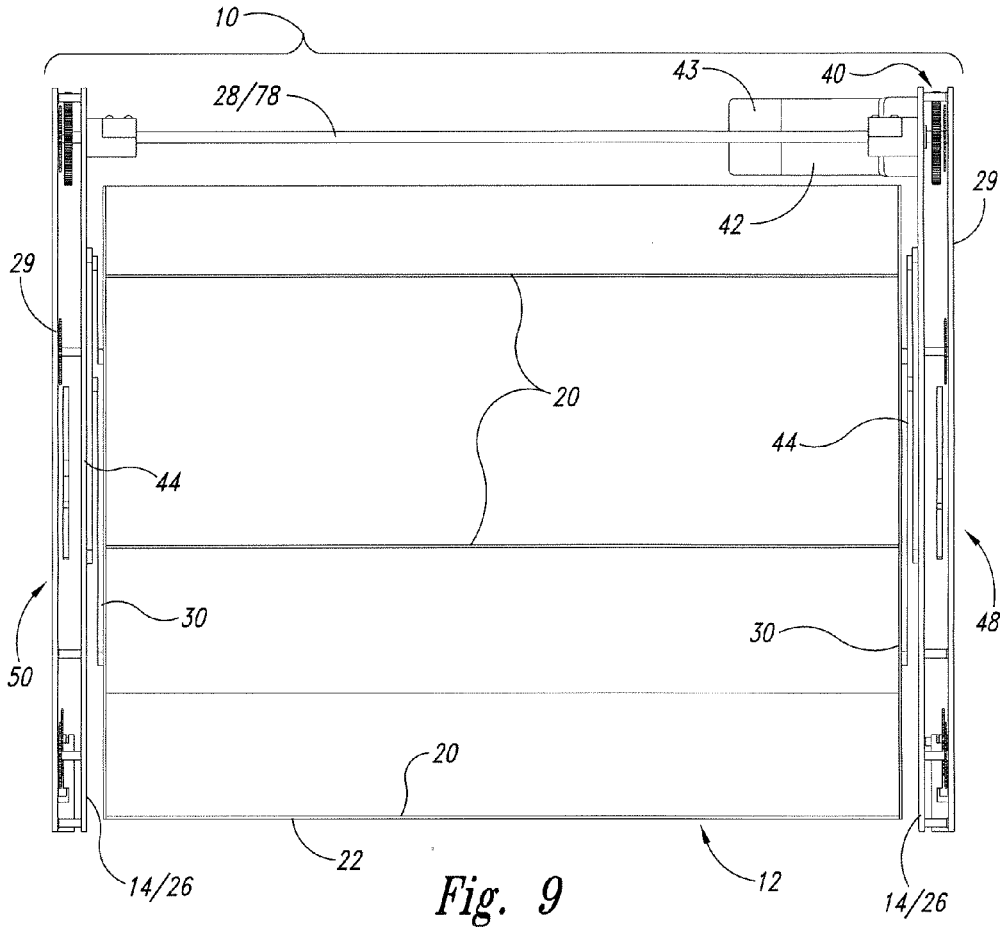
FIG. 9 is a rear view of the moveable shelf assembly of FIG. 6.
Figure 10:
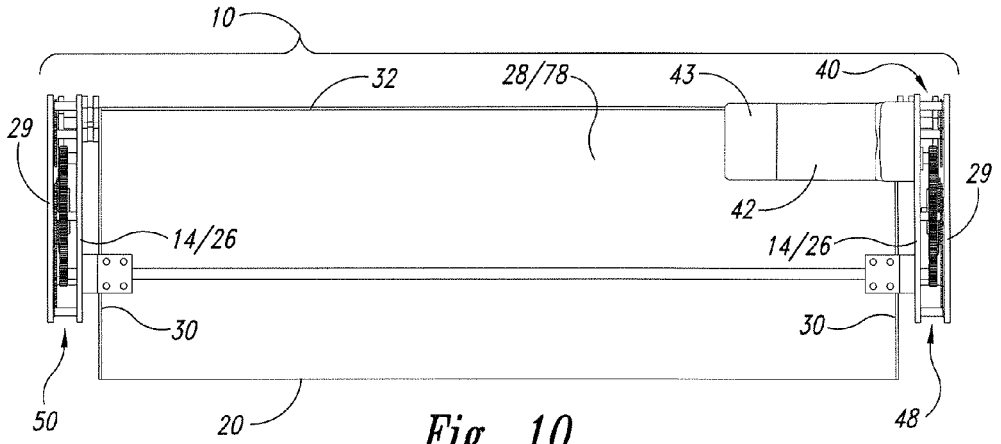
FIG. 10 is a top plan view of FIG. 9.
Figure 11:
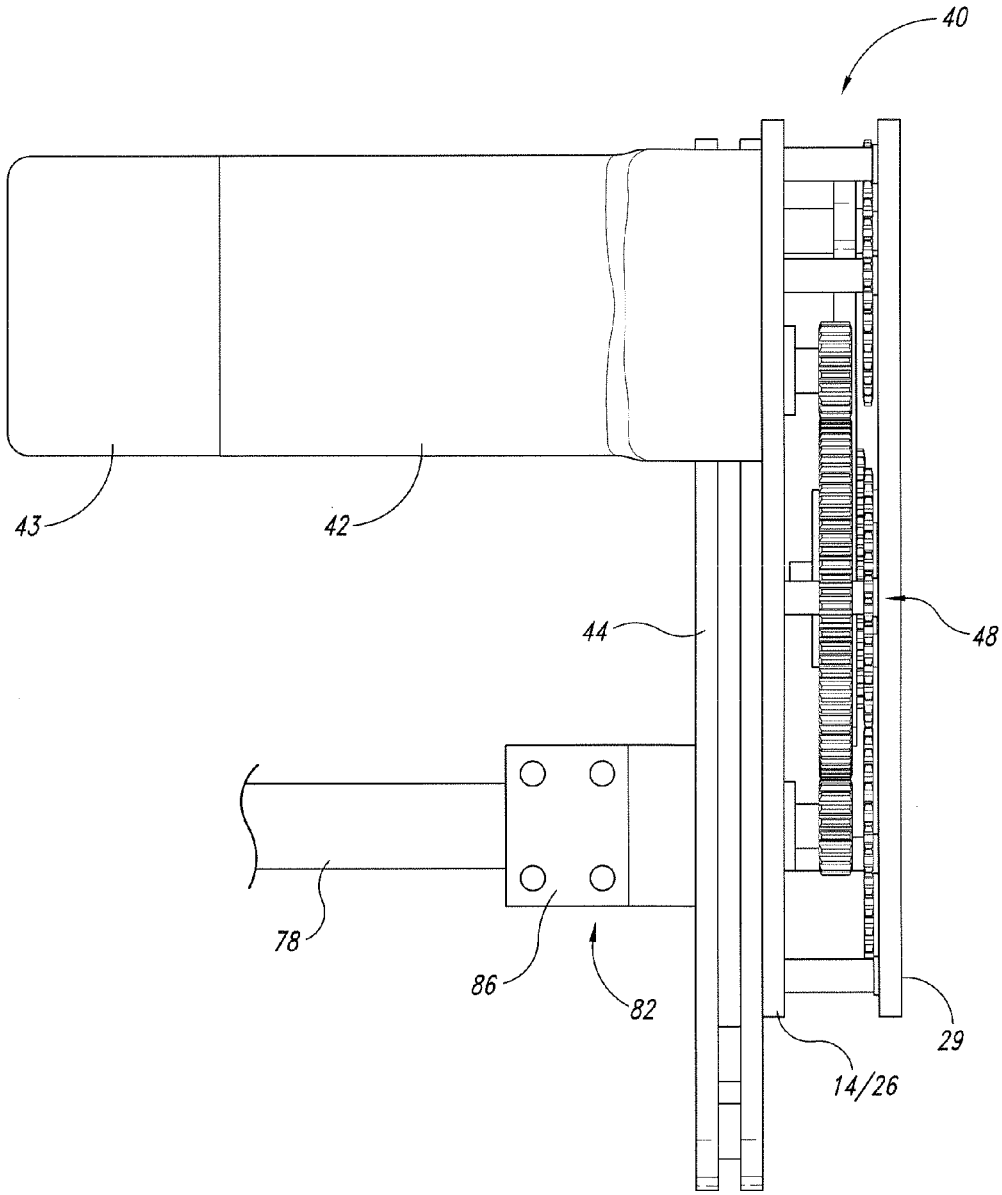
FIG. 11 is an enlarged front view of the motorized drive assembly and the master drive mechanism.
Figure 12:
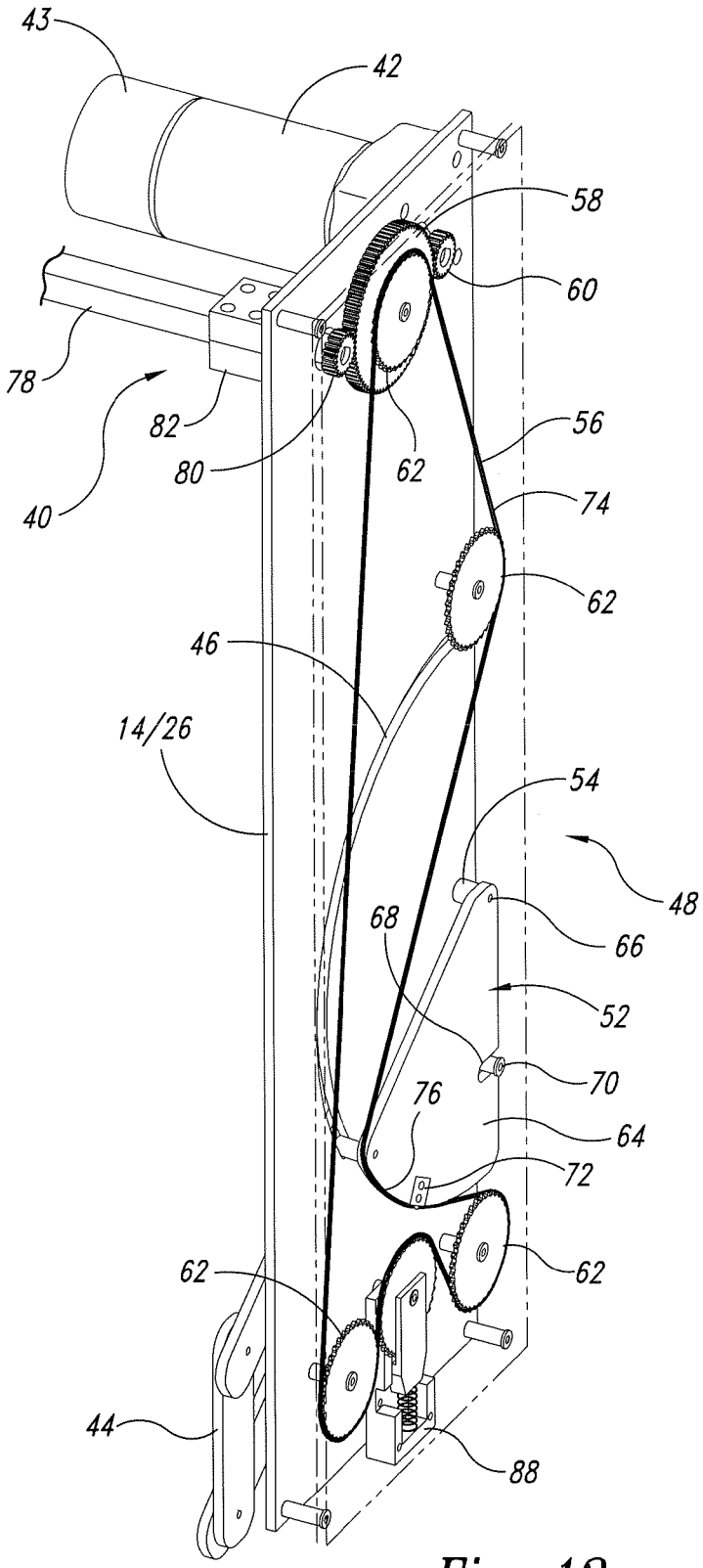
FIG. 12 is a right end perspective view like that of FIG. 6 without the shelf carriage and better illustrating the master drive mechanism with linkage arm in the fully extended position, rotary bell gear, gear configuration, and optional tensioner device.
Figure 13:
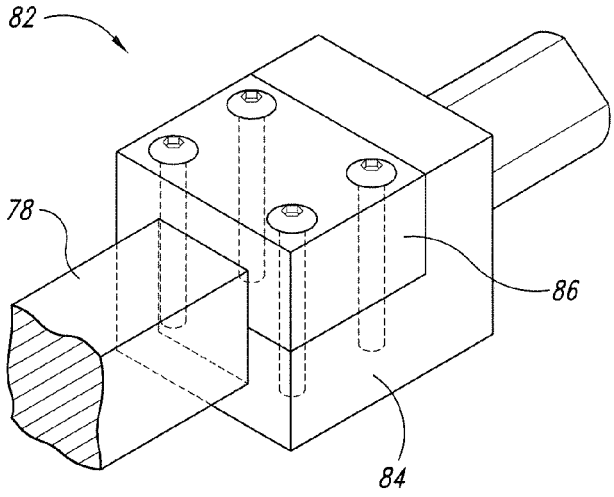
FIG. 13 is an enlarged perspective view of the rotary bell gear.
Figure 14:
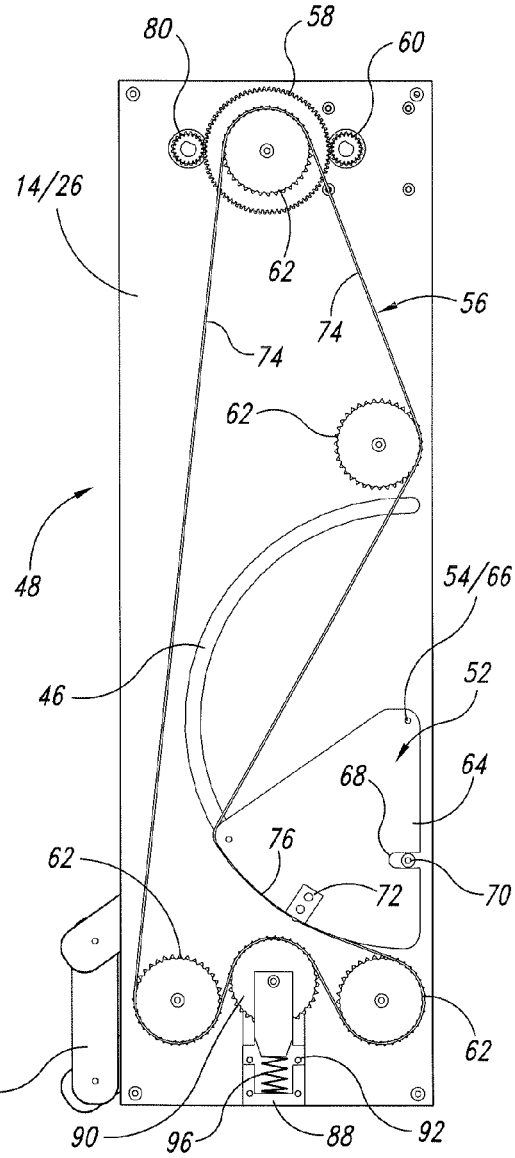
FIG. 14 is a right end view of FIG. 12.
Figure 15:
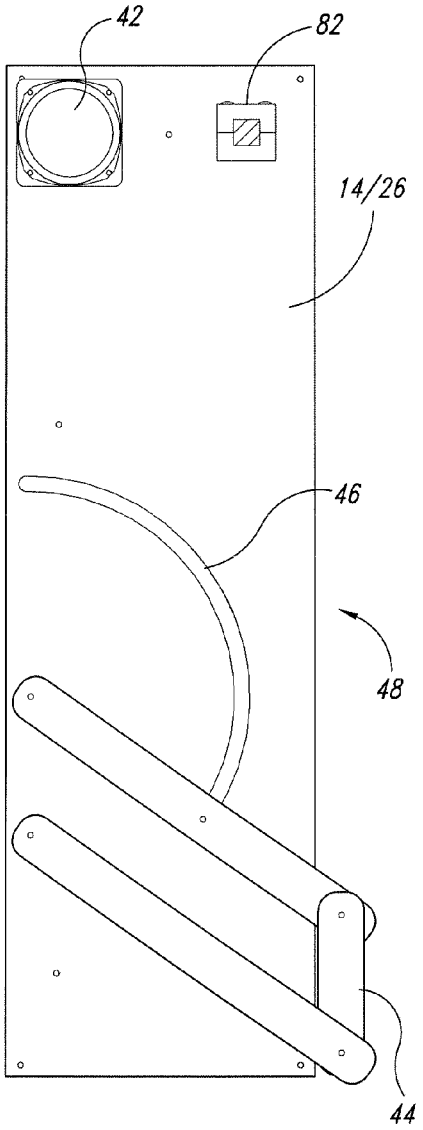
FIG. 15 is a left end view of FIG. 12.
Figure 16:
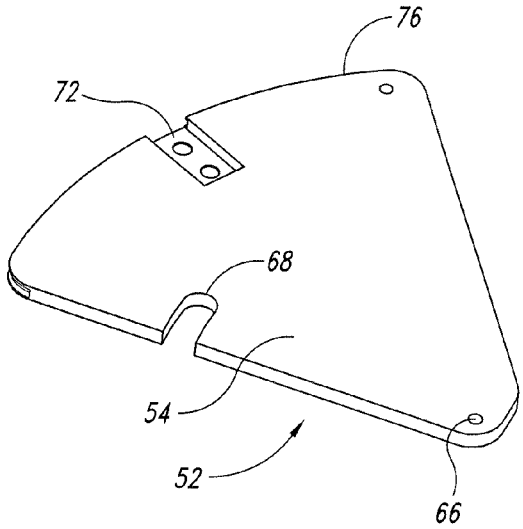
FIG. 16 is perspective view of the cross-linkage support structure.
Figure 17:
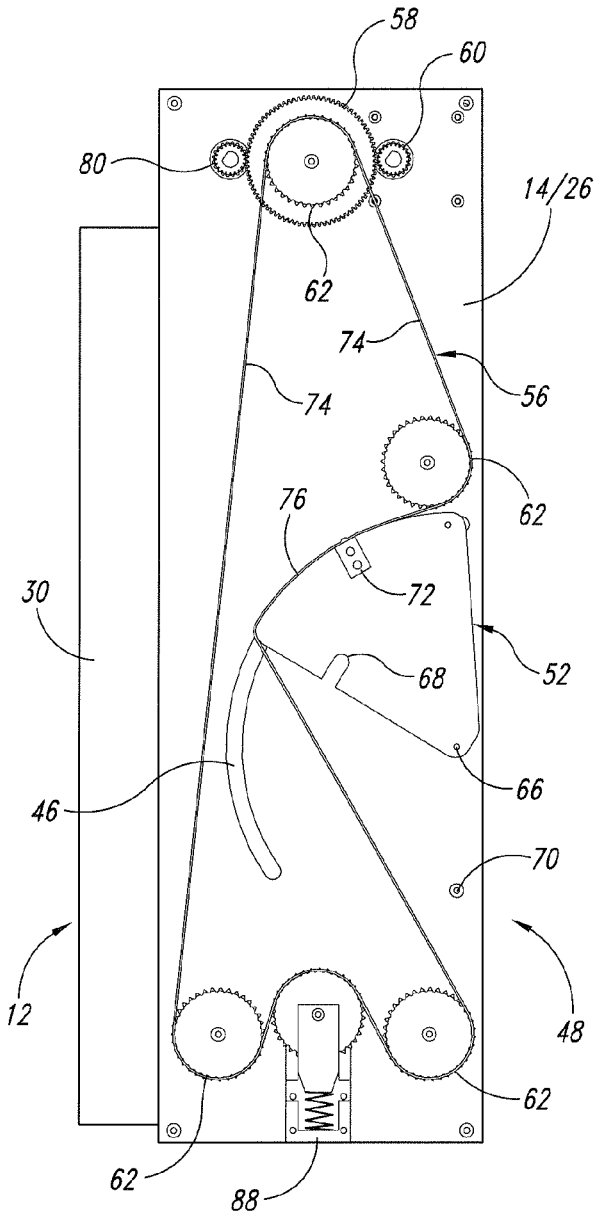
FIG. 17 is a view like that of FIG. 14 except illustrating the linkage arm in the most retracted position and illustrating placement of the shelf carriage relative to the support structure and motorized drive assembly in the fully retracted position.
Figure 18:
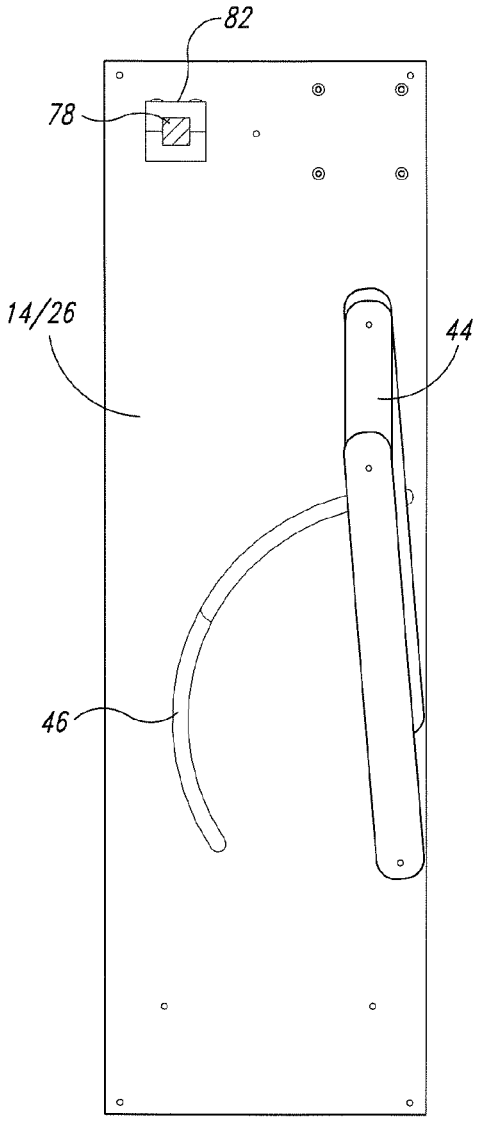
FIG. 18 is a right end view of the slave mechanism, which is nearly the mirror image of FIG. 15, except illustrating the slave mechanism's respective linkage arm in the fully retracted position.
Figure 19:
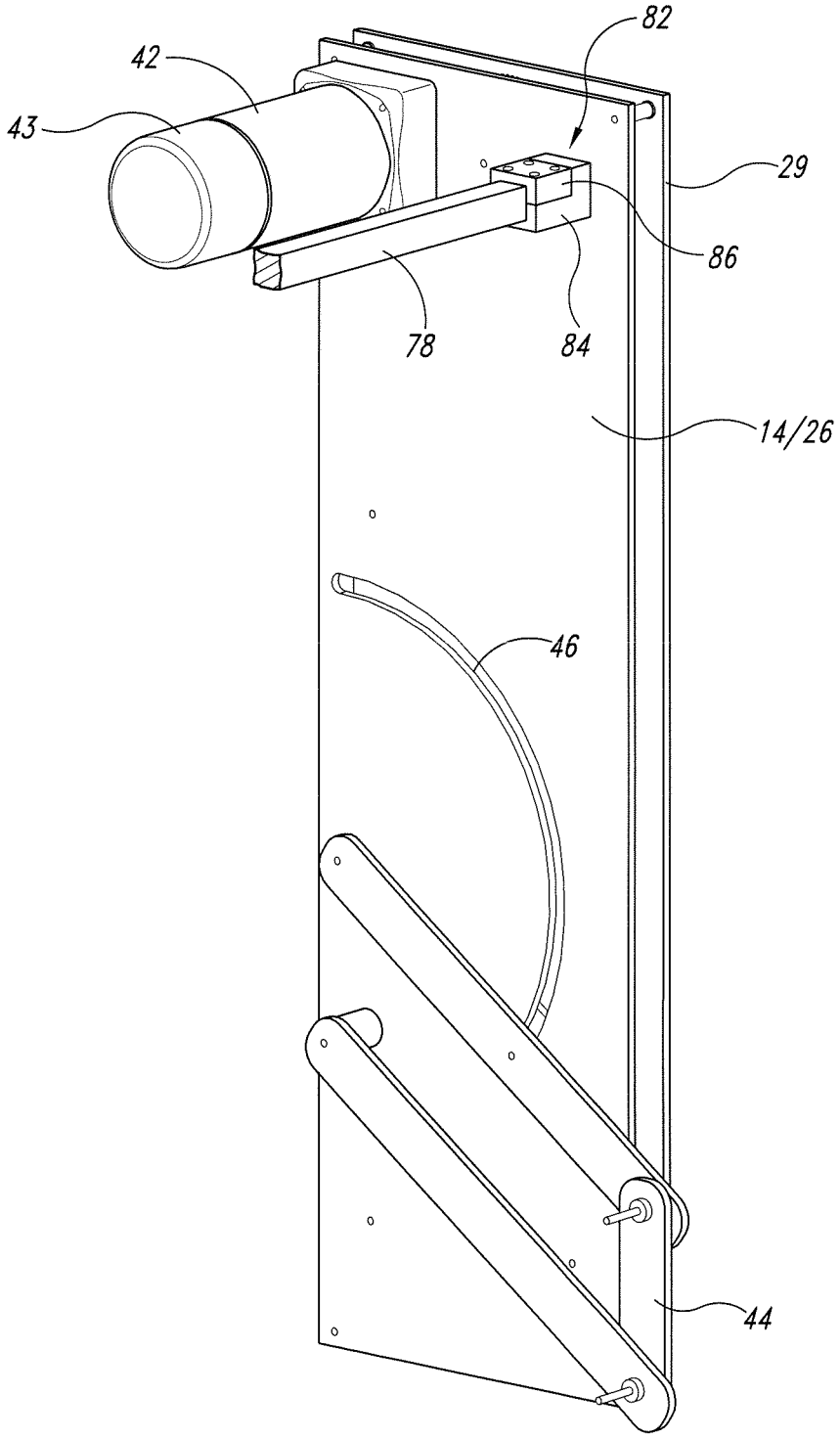
FIG. 19 is a perspective view of FIG. 15.

According to one aspect of the invention, the stationary support sidewalls 26 provide support for the master drive and slave mechanisms 48 and 50, respectively, with one stationary support sidewall 26 supporting one master or slave mechanism. In the illustration of FIG. 6, the master drive mechanism 48 is shown at the right end sidewall and the slave mechanism 50 is shown at the left end sidewall. The motor 42 is connected to the master drive assembly 48 (FIGS. 9-11). As the motor rotates, the master drive assembly moves (e.g., gears turn) moving its respective linkage arm 44 from its at rest state (FIGS. 17 and 18) to a position along its respective arcuate path 46 and ultimately (if required) to its fully extended position (FIGS. 12 and 14-15).

As discussed above, cross linkage member 78, which may also function as the cross structural support/back support 28, transfers torque to the slave mechanism 50. This transfer of torque, in turn, moves the slave mechanism's respective linkage arm 44 along its respective arcuate path 46 to mirror the rotational movement of the master drive mechanism linkage arm. For practical purposes, the slave mechanism is the same as that of the master drive mechanism except that the master drive mechanism is directly connected to the motor and transfers torque to the slave mechanism through the cross linkage member.

The motor may be powered by an electric power cord 98 and 120 v outlet (FIG. 1), 12 v dc battery, or 240 v ac source. A user may control the movement by a push button control unit 100 (FIG. 1) having an actuator and capable of sending and receiving a signal to the motor, or by a lever (not illustrated), a remote controller (not illustrated), a computer (not illustrated), a handheld computer or mobile phone (also not illustrated), or any other means well known to one of skill in the art. The movement may be jogged or stopped at any point between the "at rest" position or the fully extended position.

Figure 4:
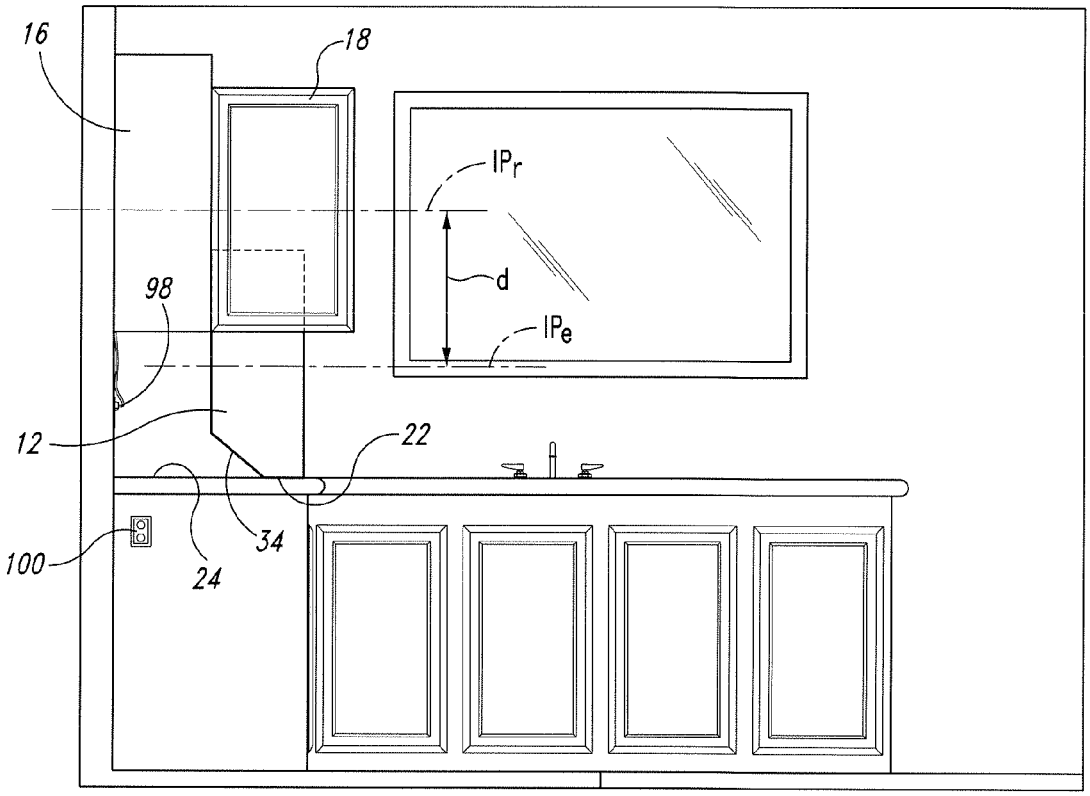
FIG. 4 is a view like FIG. 1 except better illustrating the moveable shelf assembly in its lowest (most extended) position as viewed from the side.

Referring again to FIGS. 1-4, in use the motor is activated and the linkage arms move along the arcuate path to rotationally move the shelf carriage from its first at rest position (positioned within the stationary support structure that is itself fixedly attached to the cabinet) outwardly and, in this example, downwardly of the stationary cabinet 16. At the fully extended position (or somewhere in between as desired by the user), an imaginary plane generally horizontal and half-way of the shelf carriage in the at rest position $IP_r$ is substantially above the imaginary plane of the shelf carriage in the fully extended position $IP_e$ as measured by a distance "d" (FIG. 4).

Figure 22:
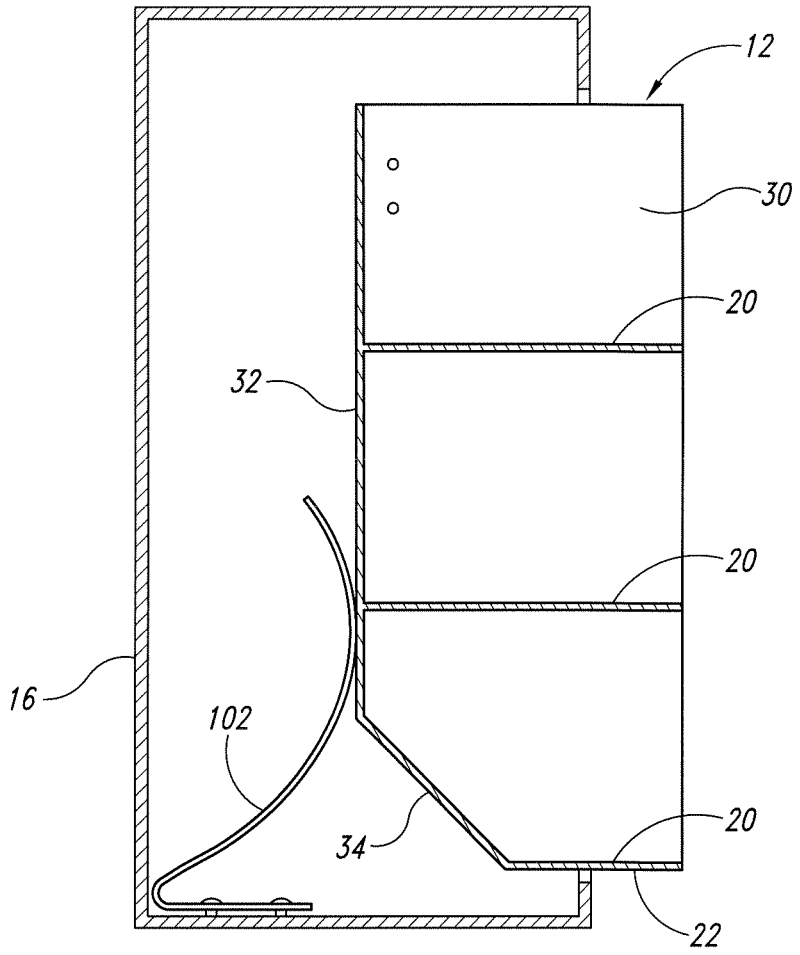
FIG. 22 is a section view taken substantially along lines 22-22 of FIG. 1 illustrating an optional normality tensioner biased against the back support member of the shelf carriage and positioned between the shelf carriage and the cabinet structure except in this view there is a further extension of the shelf carriage relative to the cabinet than the spatial relationship illustrated in FIG. 1.

Referring now to FIG. 22, the invention may also include a normality tensioner 102 that is either positioned between the back of the shelf carriage and the back of the cabinet structure or the structural support sidewalls and supporting wall. The normality tensioner may be a spring steel, e.g., 2 inches wide 0.065 inches thick, and intended to convey a bias to hold the shelf carriage from further reward movement.

Figure 23:
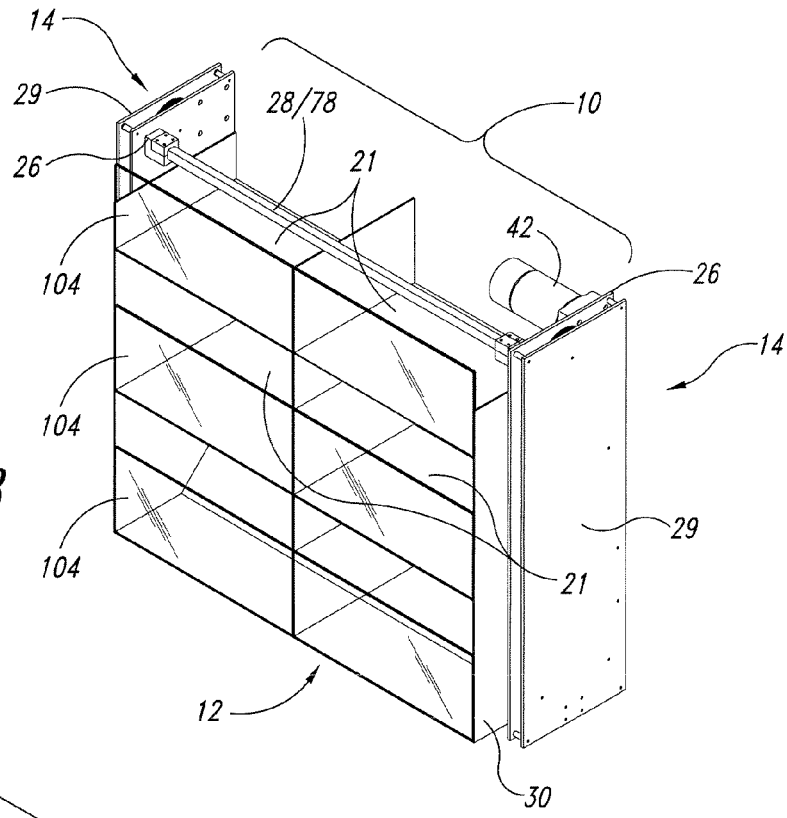
FIG. 23 is a first alternate embodiment of the moveable shelf assembly of FIG. 5 illustrating a barrier in front of each individual shelf or shelf unit of the shelf carriage.

Another embodiment of the invention is illustrated in FIG. 23 in which barriers 104 may be added to the front of each shelf 20 or shelf unit or multitude of shelf units in various patterns to restrain movement of items on the shelf (e.g., cans of soup) from dislodging outwardly during movement. These barriers may be four-six inches in height (or more depending on the height and stability of the items being stored on the shelves). The barriers may be made of metal, wood, or clear plastic or other man-made material (as illustrated).

Figure 24:
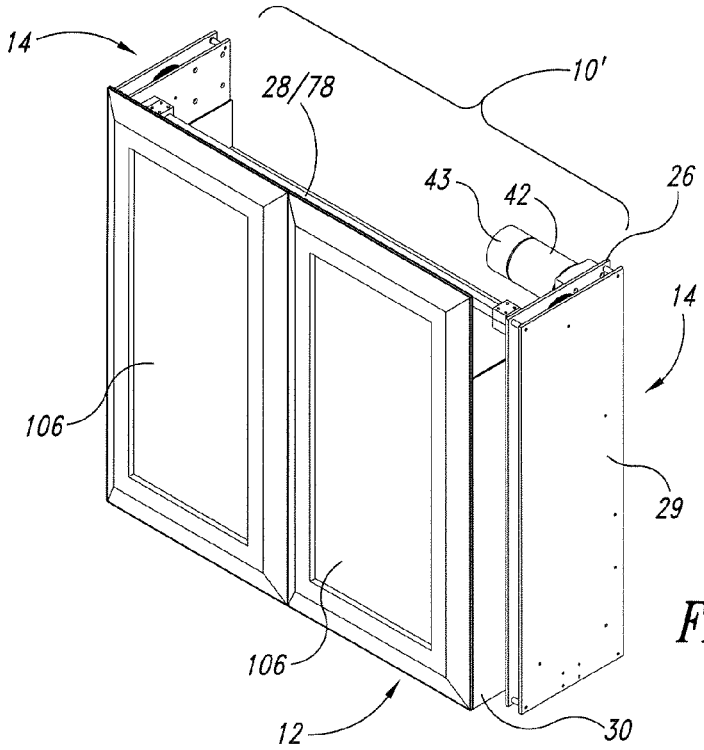
FIG. 24 is a second alternate embodiment of the moveable shelf assembly of FIG. 5 in which a door assembly is attached to the front of the shelf carriage.
Figure 26:
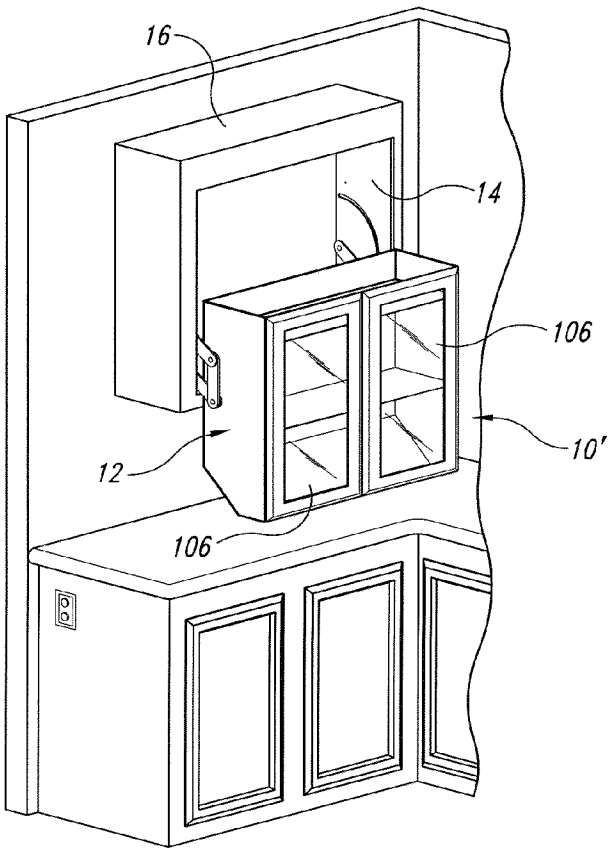
FIG. 26 is a view like FIG. 25 except illustrating the shelf carriage moved to its lowest position.
Figure 25:
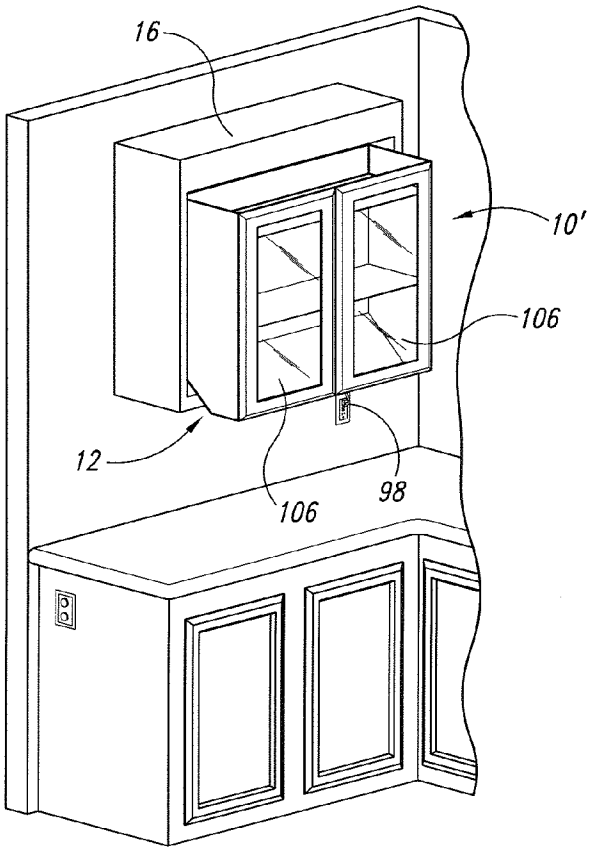
FIG. 25 is a view like FIG. 2 except illustrating movement with the addition of the door assembly of FIG. 24 except with the addition of see-through door panels.
Figure 28:
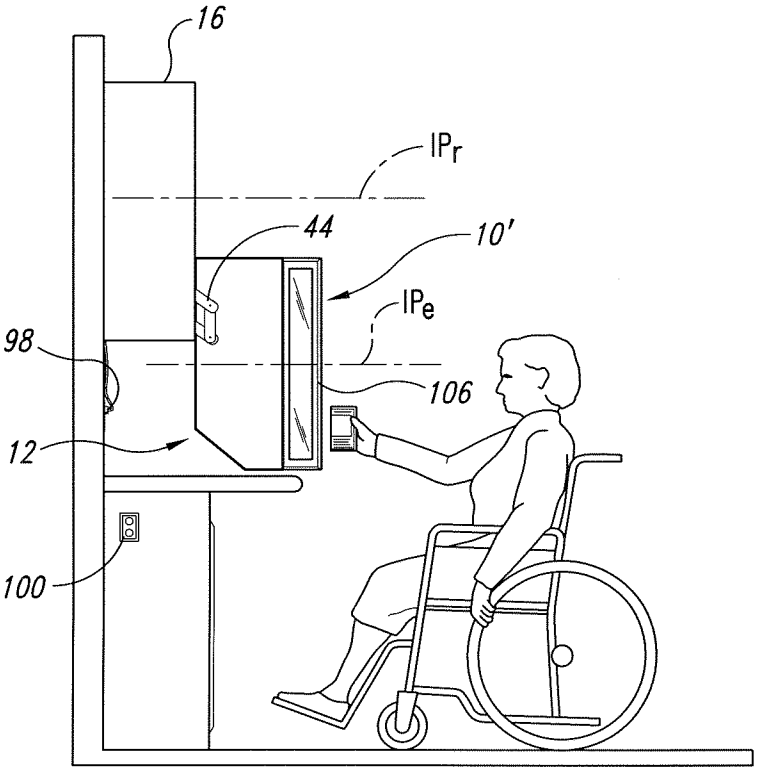
FIG. 28 is a view like that of FIG. 27 except illustrating the person accessing contents (e.g., can of soup) from the shelf carriage.
Figure 27:
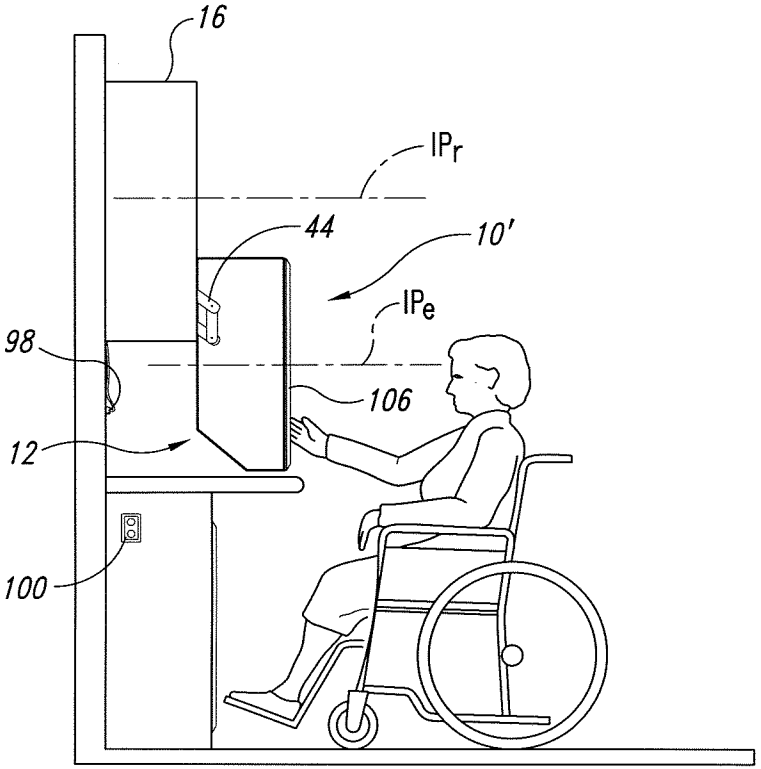
FIG. 27 is a view like that of FIG. 4 except illustrating the door assembly of FIG. 25 and as may be accessed by a person with limited mobility.

Another embodiment of the moveable shelf assembly 10' is illustrated in FIG. 24 where doors 106 may be added to the front of shelf carriage 12 and removed from or in lieu of doors on the cabinet structure. In this embodiment, the shelf carriage 12 moves the same as it did in FIGS. 1-4, but here, doors 106 are attached to sidewalls 30 of shelf carriage 12 and generally stay closed during movement of the shelf carriage (e.g., FIGS. 25 and 26) and opened when the shelf carriage has reached its desired location (e.g., FIGS. 27 and 28). Doors 106 may be hinged or otherwise attached to the front or leading edges of sidewalls 30. Protective barrier(s) 104, as discussed above, may also be added to this embodiment, as well.

Figure 29:
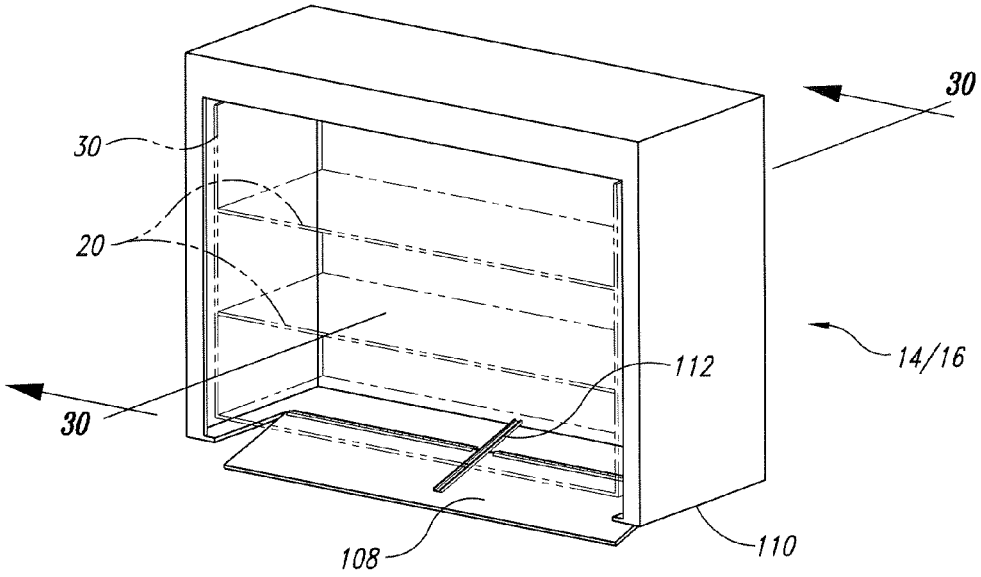
FIG. 29 is a perspective view of an another alternate embodiment of the moveable shelf assembly of the present invention illustrating a cabinet structure with a hinged bottom flap and a rail assembly.
Figure 30:
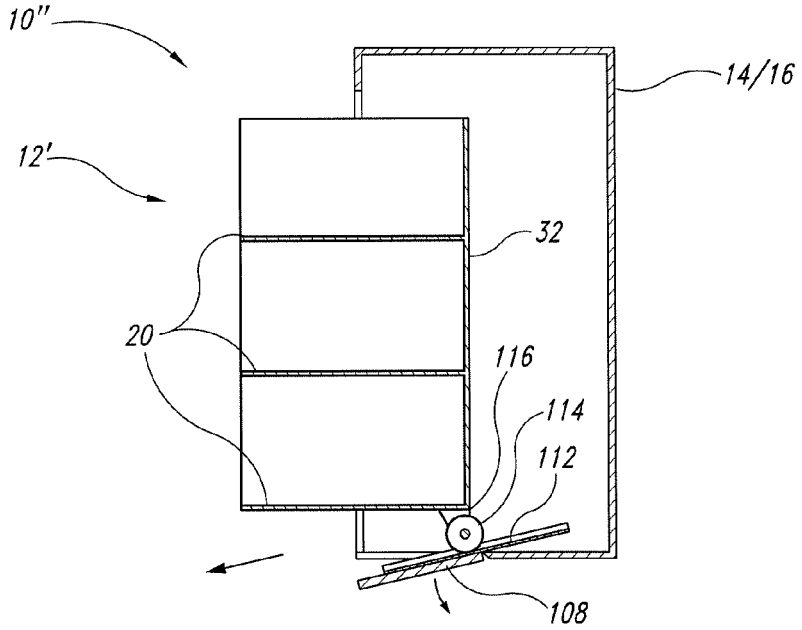
FIG. 30 is a section view taken substantially along lines 30-30 of the embodiment of FIG. 29.

Referring to FIGS. 29 and 30, another embodiment of the moveable shelf assembly 10" is illustrated. In this embodiment, structural support (back support) 14 or cabinet 16 (as illustrated) includes a moveable bottom flap 108 that is hinged (e.g., continuous or "piano"-hinged) to a bottom rear edge 110 of the cabinet 16 or back support of the structural support. Bottom flap 108 includes a rail 112, preferably cantilevered and generally oriented front-to-rear of bottom flap 108 toward the back of the cabinet 16 or a back wall to which the structural support sidewalls are attached. A wheel 114 is fixedly-attached to a lower back edge 116 of shelf carriage 12' (with no chamfered rear edge). Wheel 114 is of a size to engage rail 112 such that in movement (from the motorized drive assembly described above) allows the shelf carriage 12' to move outwardly and downwardly of cabinet 16 or stationary support 14 (not illustrated) via the moveable bottom flap 108, rail 112, and wheel 114. This embodiment allows for a full bottom shelf or substantially full bottom within shelf carriage 12' that the chamfered rear of shelf carriage 12' does not.

The present invention can be made in kit form to accommodate and retrofit existing cabinet structures or as a complete cabinet unit that is sold as a complete moveable shelf cabinet. The moveable shelf unit may be made of metal, hardwoods (mostly for aesthetic purposes), or robust man-made materials or a combination thereof.

Further, the invention can be easily configured to move the shelf carriage from a lower position (e.g., underneath a staircase) to an upper position where the application so requires.

The illustrated embodiments are only examples of the present invention and, therefore, are non-limitive. It is to be understood that many changes in the particular structure, materials, and features of the invention may be made without departing from the spirit and scope of the invention. Therefore, it is the Applicant's intention that his patent rights not be limited by the particular embodiments illustrated and described herein, but rather by the following claims interpreted according to accepted doctrines of claim interpretation, including the Doctrine of Equivalents and Reversal of Parts.

What is claimed is:

1. A moveable shelf assembly comprising:

a shelf carriage having a pair of generally equally spaced-apart sidewalls interconnected by a back support member, and at least one generally horizontally-orientated shelf or shelf unit forming a structure having length, width, depth, and a front; wherein an imaginary horizontal plane intersects the shelf carriage approximately halfway of the length of the structure thereby dividing the shelf carriage into an imaginary top half and a bottom half;

a pair of stationary support sidewalls spaced apart a distance that the shelf carriage sidewalls can pass within and outside of the stationary support sidewalls; and motorized means for moving the shelf carriage from a first at rest position positioned substantially within the stationary support sidewalls to a second extended position so that the imaginary horizontal plane of the shelf carriage is in a lower horizontal plane in the extended position than that of the imaginary horizontal plane of the shelf carriage in the at rest position, wherein the motorized means further includes:

(i) a drive mechanism positioned at each of the stationary support sidewalls, each drive mechanism having a linkage arm assembly that is interconnected to one of the shelf carriage sidewalls, said linkage arm assembly moveable along an arcuate pathway within its respective stationary support sidewall to allow the linkage arm assembly rotary movement; and (ii) a controllable powered motor to provide rotational movement to the drive mechanism wherein one drive mechanism is a master drive mechanism positioned at one of the stationary support sidewalls having a linkage arm assembly that is interconnected to the one of the shelf carriage sidewalls, and the other drive mechanism is a slave mechanism positioned at the other stationary support sidewall with a cross-linkage between the master drive mechanism and the slave drive mechanism so that linkage arm of the slave mechanism follows the same rotary movement as that of the linkage arm assembly of the master drive mechanism.

2. The moveable shelf assembly of claim 1 wherein the shelf carriage includes a bottom plate that spans between the shelf carriage sidewalls and wherein the bottom plate further includes a chamfered rear edge.

3. The moveable shelf assembly of claim 1 wherein the structural support includes a back support member is a plate that has a lower edge and a front and back where the back is continuously hinged to the lower edge of the back support plate and opens outwardly and downwardly from the hinged edge; and wherein said moveable shelf assembly further includes (i) a rail that is positioned atop the moveable bottom flap generally oriented from the front to the back and (ii) a wheel adapted to guide within the rail, said wheel is fixedly attached to the shelf carriage at or near the lower edge of the back support plate.

4. The moveable shelf assembly of claim 1 wherein the shelf carriage further includes a barrier adapted to fit to the leading edge of the at least one shelf or shelf unit.

5. The moveable shelf assembly of claim 1 wherein the stationary support sidewalls are adapted to fit within a cabinet structure.

6. The moveable shelf assembly of claim 1 wherein the shelf carriage includes a door assembly that covers the front of the shelf carriage, including the at least one shelf, during movement of the shelf carriage from the at rest position to the extended position.

7. The moveable shelf assembly of claim 1 wherein the stationary support sidewalls are fixedly attached to a stationary structure.

8. A moveable shelf assembly comprising:

(a) a moveable shelf carriage having (i) a pair of generally equally spaced-apart sidewalls interconnected by a back support member;

(ii) a bottom plate that interconnects and joins the two sidewalls and forms the bottom of the shelf; and (iii) at least one horizontally orientated shelf or shelf unit supported by and positioned within the pair of sidewalls and the back support member;

(b) a stationary support of a size that can be adapted to fit within a conventional cabinet structure, said stationary support having a pair of sidewalls spaced apart of a distance that fit within a conventional cabinet structure and that the moveable shelf carriage sidewalls can move within and outside of the stationary support sidewalls, and a back support member;

(c) a motorized drive assembly including (i) a drive mechanism positioned at each of the stationary support sidewalls, each drive mechanism having a linkage arm assembly that is interconnected to one of the shelf carriage sidewalls, said linkage arm assembly moveable along an arcuate pathway within its respective stationary support sidewall to allow the linkage arm assembly rotary movement; and (ii) a controllable powered motor to provide rotational movement to the drive mechanism wherein one drive mechanism is a master drive mechanism positioned at one of the stationary support sidewalls having a linkage arm assembly that is interconnected to the one of the shelf carriage sidewalls, and the other drive mechanism is a slave mechanism positioned at the other stationary support sidewall with a cross-linkage between the master drive mechanism and the slave drive mechanism so that linkage arm of the slave mechanism follows the same rotary movement as that of the linkage arm assembly of the master drive mechanism.

9. The moveable shelf assembly of claim 8 wherein the master drive and slave mechanisms each comprise a chain-driven gear system having a rotary bell gear assembly to achieve a 4:1 gear ratio.

10. The moveable shelf assembly of claim 9 wherein each chain-driven gear system further comprises a tensioning device to take up unnecessary slack.

11. The moveable shelf assembly of claim 8 wherein the shelf carriage further includes a barrier adapted to fit to the leading edge of the at least one shelf.

12. The moveable shelf assembly of claim 8 wherein wherein the bottom plate has a chamfered rear edge to that the shelf carriage as viewed from the end has a chamfered edge.

13. The moveable shelf assembly of claim 8 wherein the shelf carriage includes a door assembly that covers the front of the shelf carriage, including the at least one shelf, during movement of the shelf carriage from the at rest position to the extended position.

14. A moveable shelf assembly comprising:

(a) a stationary support having a pair of sidewalls spaced apart of a distance that fit within a conventional cabinet structure and that a moveable shelf carriage sidewalls can move within and outside of the stationary support sidewalls; said stationary support also having a back support structure to which a moveable bottom flap including a front and back in which the back is hinged to the lower edge of the back support and opens outwardly and downwardly from the hinged edge;

(b) said moveable shelf carriage having (i) a pair of generally equally spaced-apart sidewalls interconnected by a back support having a lower edge;

(ii) a rail that is positioned atop the moveable bottom flap generally oriented from the front to the back;

(iii) a wheel adapted to guide within the rail, said wheel is fixedly attached to the shelf carriage at or near the lower edge of the back support plate; and (iv) at least one horizontally orientated shelf or shelf unit supported by and spanning between the pair of sidewalls and the back support member;

(c) a motorized drive assembly including:

(i) a drive mechanism positioned at each of the stationary support sidewalls, each drive mechanism having a linkage arm assembly that is interconnected to one of the shelf carriage sidewalls, said linkage arm assembly moveable along an arcuate pathway within its respective stationary support sidewall to allow the linkage arm assembly rotary movement; and (ii) a controllable powered motor to provide rotational movement to the drive mechanism wherein one drive mechanism is a master drive mechanism positioned at one of the stationary support sidewalls having a linkage arm assembly that is interconnected to the one of the shelf carriage sidewalls, and the other drive mechanism is a slave mechanism positioned at the other stationary support sidewall with a cross-linkage between the master drive mechanism and the slave drive mechanism so that linkage arm of the slave mechanism follows the same rotary movement as that of the linkage arm assembly of the master drive mechanism.

15. The moveable shelf assembly of claim 14 wherein the master drive and slave mechanisms each comprise a chain-driven gear system having a rotary bell gear assembly to achieve a 4:1 gear ratio.

16. The moveable shelf assembly of claim 15 wherein each chain-driven gear system further comprises a tensioning device to take up unnecessary slack.

17. The moveable shelf assembly of claim 14 wherein the shelf carriage further includes a barrier adapted to fit to the leading edge of the at least one shelf or shelf unit.

18. The moveable shelf assembly of claim 14 wherein the stationary support sidewalls are adapted to fit within a cabinet structure.

19. The moveable shelf assembly of claim 14 wherein the shelf carriage includes a door assembly that covers the front of the shelf carriage, including the at least one shelf or shelf unit, during movement of the shelf carriage from the at rest position to the extended position.

20. A cabinet with moveable shelf assembly comprising:

a cabinet structure;

a shelf carriage having a pair of generally equally spaced-apart sidewalls interconnected by a back support member, and at least one generally horizontally-orientated shelf or shelf unit forming a structure having length, width, depth, and a front; wherein an imaginary horizontal plane intersects the shelf carriage approximately halfway of the length of the structure thereby dividing the shelf carriage into an imaginary top half and a bottom half;

a pair of stationary support sidewalls spaced apart a distance that the shelf carriage sidewalls can pass within and outside of the stationary support sidewalls; and motorized means for moving the shelf carriage from a first at rest position positioned substantially within the stationary support sidewalls to a second extended position so that the imaginary horizontal plane of the shelf carriage is in a lower horizontal plane in the extended position than that of the imaginary horizontal plane of the shelf carriage in the at rest position, wherein the motorized means further comprises a motorized drive assembly including:

(i) a drive mechanism positioned at each of the stationary support sidewalls, each drive mechanism having a linkage arm assembly that is interconnected to one of the shelf carriage sidewalls, said linkage arm assembly moveable along an arcuate pathway within its respective stationary support sidewall to allow the linkage arm assembly rotary movement; and (ii) a controllable powered motor to provide rotational movement to the drive mechanism wherein one drive mechanism is a master drive mechanism positioned at one of the stationary support sidewalls having a linkage arm assembly that is interconnected to the one of the shelf carriage sidewalls, and the other drive mechanism is a slave mechanism positioned at the other stationary support sidewall with a cross-linkage between the master drive mechanism and the slave drive mechanism so that linkage arm of the slave mechanism follows the same rotary movement as that of the linkage arm assembly of the master drive mechanism.

21. A method of retrofitting a cabinet structure to include moveable shelves, the method comprising:

providing a cabinet and remove any existing shelves;

providing a moveable shelf carriage that has a pair of spaced-apart sidewalls, a back support member, and a desired number of generally horizontally-oriented shelves that span between the sidewalls and the back support;

providing two support structure sidewalls, each having their own similar linkage arm assembly rotatably connected to each sidewall and moveable along a similar arcuate pathway and a drive mechanism positioned at each of the support structure sidewalls that can move the linkage arm assemblies between one end of the arcuate pathway to the other end of the arcuate pathway;

installing the two support structure sidewalls within the cabinet such that the two support structure sidewalls are spaced apart a distance to which the shelf carriage sidewalls will be able to move within and outside of the two spaced-apart support structure sidewalls;

interconnecting each linkage arm assembly to its respective shelf carriage sidewall;

installing a controllable and powered motor to move the drive mechanisms, wherein one drive mechanism is a master drive mechanism positioned at one of the support structure sidewalls, and the other drive mechanism is a slave mechanism positioned at the other support structure sidewall; and installing a cross-linkage between the master drive mechanism and the slave mechanism thereby making the linkage arm assembly of the slave mechanism to follow the same rotary movement of the linkage arm assembly of the master drive mechanism.

22. The method according to claim 21 wherein the master drive and slave mechanisms each comprise a chain-driven gear system having a rotary bell gear assembly to achieve a 4:1 gear ratio.

* * * * *